US010411390B2

(12) United States Patent
Wu et al.

(10) Patent No.: US 10,411,390 B2
(45) Date of Patent: Sep. 10, 2019

(54) ELECTRICAL CONNECTOR WITH DETACHABLE PROTECTIVE COVER ATTACHED THEREON

(71) Applicant: FOXCONN INTERCONNECT TECHNOLOGY LIMITED, Grand Cayman (KY)

(72) Inventors: Heng-Kang Wu, Shenzhen (CN); Fu-Jin Peng, Shenzhen (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/849,641

(22) Filed: Dec. 20, 2017

(65) Prior Publication Data

US 2018/0175538 A1 Jun. 21, 2018

(30) Foreign Application Priority Data

Dec. 20, 2016 (CN) ..... 2016 1 1185675

(51) Int. Cl.
*H01R 12/71* (2011.01)
*H01R 13/447* (2006.01)
*H01R 13/52* (2006.01)

(52) U.S. Cl.
CPC ..... *H01R 13/447* (2013.01); *H01R 12/716* (2013.01); *H01R 13/5213* (2013.01)

(58) Field of Classification Search
CPC ..... H01R 13/447; H01R 12/716
USPC ..... 439/41, 521, 940, 135, 136, 142, 143, 439/160; 361/704–807
See application file for complete search history.

(56) References Cited

U.S. PATENT DOCUMENTS 5,936,202 A * 8/1999 Yovan ..... H01R 13/5213 174/135
6,282,093 B1 * 8/2001 Goodwin ..... H01L 23/4006 165/185
6,431,900 B1 8/2002 Yu
6,984,139 B1 * 1/2006 Lai ..... H01R 13/447 439/142

(Continued)

FOREIGN PATENT DOCUMENTS

CN 103715545 A 4/2014
CN 204243357 U 4/2015

(Continued)

*Primary Examiner* — Edwin A. Leon
*Assistant Examiner* — Milagros Jeancharles
(74) *Attorney, Agent, or Firm* — Wei Te Chung; Ming Chieh Chang

(57) ABSTRACT

An electrical connector assembly includes an electrical connector and a protective cap assemble thereon. The electrical connector includes an insulative housing forming receiving cavity, and a plurality of contacts disposed in the housing and extending into the receiving cavity. The protective cap includes a planar body, a first latching section linked with the planar body, and an operation section extending above the planar body. A securing seat surrounds the housing and includes a second latching section engaged with the first latching section. By applying fingers upon the operation section to rotate/twist the cap, the first latching section and the second latching section is disengaged from each other, and the cap can be easily upwardly withdrawn from the securing seat.

4 Claims, 7 Drawing Sheets

(56) References Cited

U.S. PATENT DOCUMENTS

| | | | | |
|---|---|---|---|---|
| 7,071,720 | B2 * | 7/2006 | Colbert | H05K 7/1061 324/750.25 |
| 7,140,890 | B1 * | 11/2006 | Ju | H01R 43/205 439/135 |
| 7,190,586 | B2 * | 3/2007 | Franz | H01L 23/4093 165/185 |
| 7,218,524 | B2 * | 5/2007 | Yu | H01L 23/4006 165/185 |
| 7,292,447 | B2 * | 11/2007 | Xia | H01L 23/4093 165/185 |
| 7,423,882 | B1 * | 9/2008 | Tong | H01L 23/4093 165/104.33 |
| 7,534,114 | B2 * | 5/2009 | Liao | H01R 13/5213 439/135 |
| 7,796,390 | B1 * | 9/2010 | Cao | H01L 23/4006 165/80.3 |
| 8,142,201 | B2 * | 3/2012 | Fan | H05K 7/1007 439/135 |
| 8,398,411 | B2 * | 3/2013 | Chien | H01L 23/4006 439/331 |
| 2007/0015405 | A1 | 1/2007 | Tsai | |
| 2018/0190561 | A1 * | 7/2018 | Wu | H01L 23/32 |
| 2019/0088572 | A1 * | 3/2019 | Wu | H01L 23/4006 |
| 2019/0115282 | A1 * | 4/2019 | Wu | H01L 23/4006 |

FOREIGN PATENT DOCUMENTS

| | | |
|---|---|---|
| CN | 205212058 U | 5/2016 |
| CN | 205583230 U | 9/2016 |

* cited by examiner

ELECTRICAL CONNECTOR WITH DETACHABLE PROTECTIVE COVER ATTACHED THEREON

FIELD OF THE DISCLOSURE

The invention is related to an electrical connector, and particularly to the connector with the protective cap detachably attached upon the connector.

DESCRIPTION OF RELATED ARTS

U.S. Patent Application Publication No. 20170149168 discloses an electrical connector equipped with a detachable protective cap for protecting the contacts and/or preventing the dust. Anyhow, the attachment and/or detachment of the cap results from forcible pressing and frictional withdrawal of the cap, thus tending to damage/wear the retention structure of the cap disadvantageously.

It is desired to provide a connector with an easy operation and less wearing retention mechanism of the detachable protective cap.

SUMMARY OF THE DISCLOSURE

To achieve the above desire, an electrical connector assembly includes an electrical connector and a protective cap assemble thereon. The electrical connector includes an insulative housing forming receiving cavity, and a plurality of contacts disposed in the housing and extending into the receiving cavity. The protective cap includes a planar body, a first latching section linked with the planar body, and an operation section extending above the planar body. A securing seat surrounds the housing and includes a second latching section engaged with the first latching section. By applying fingers upon the operation section to rotate/twist the cap, the first latching section and the second latching section is disengaged from each other, and the cap can be easily upwardly withdrawn from the securing seat.

DETAILED DESCRIPTION OF THE PREFERRED EMBODIMENT

Figure 1:
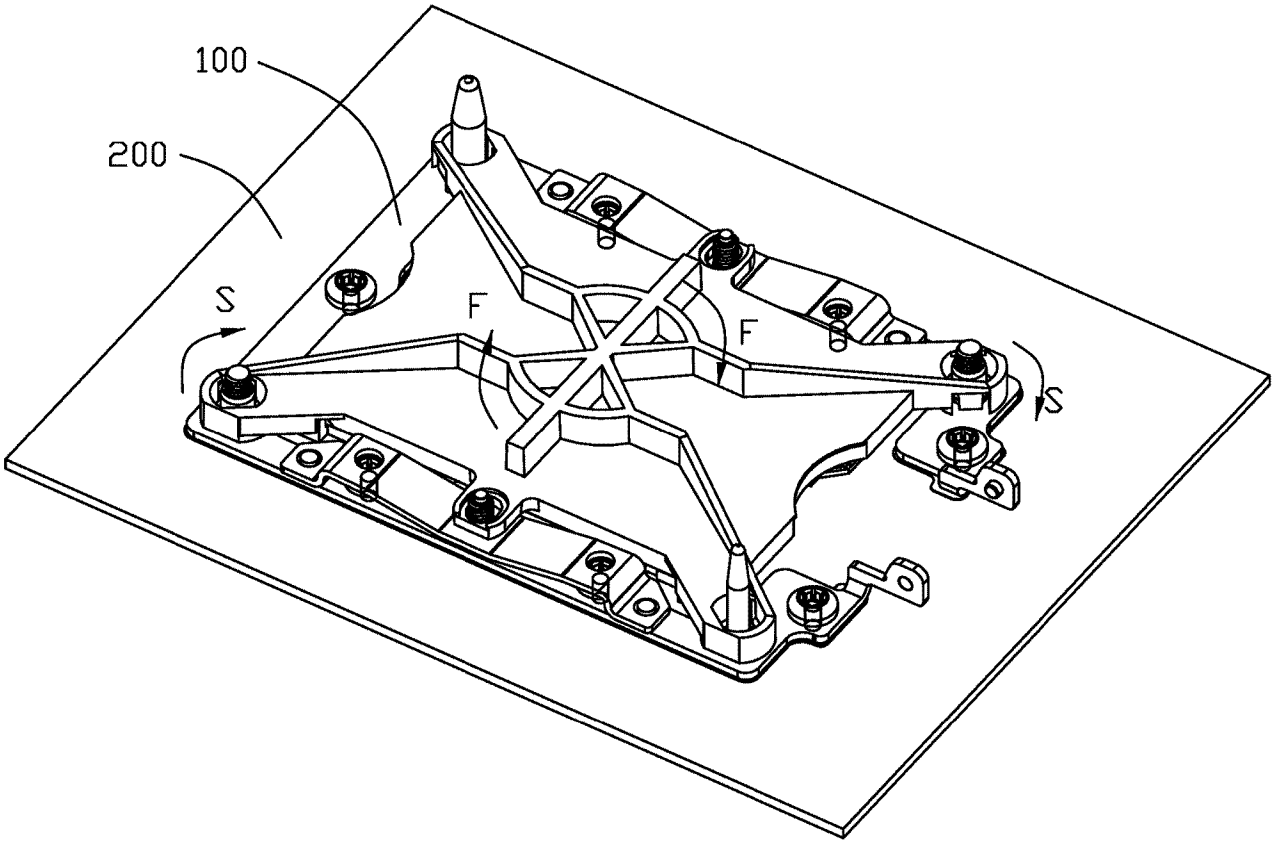
FIG. 1 is a perspective view of the electrical connector assembly including an electrical connector mounted upon a printed circuit board with the protective cap attached thereon according to the invention.
Figure 2:
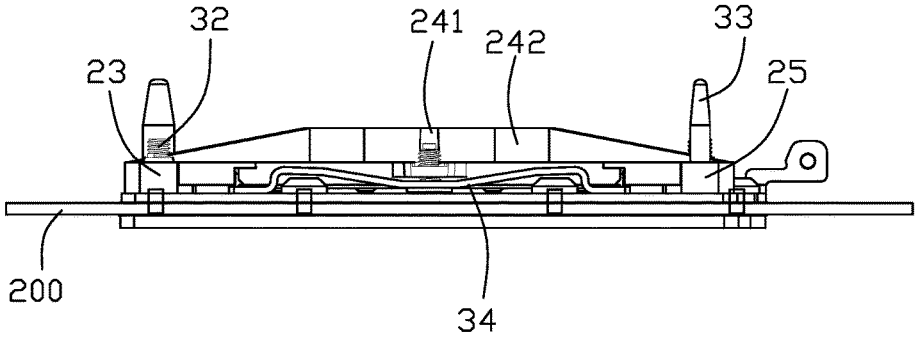
FIG. 2 is a side view of the electrical connector assembly of FIG. 1.
Figure 3:
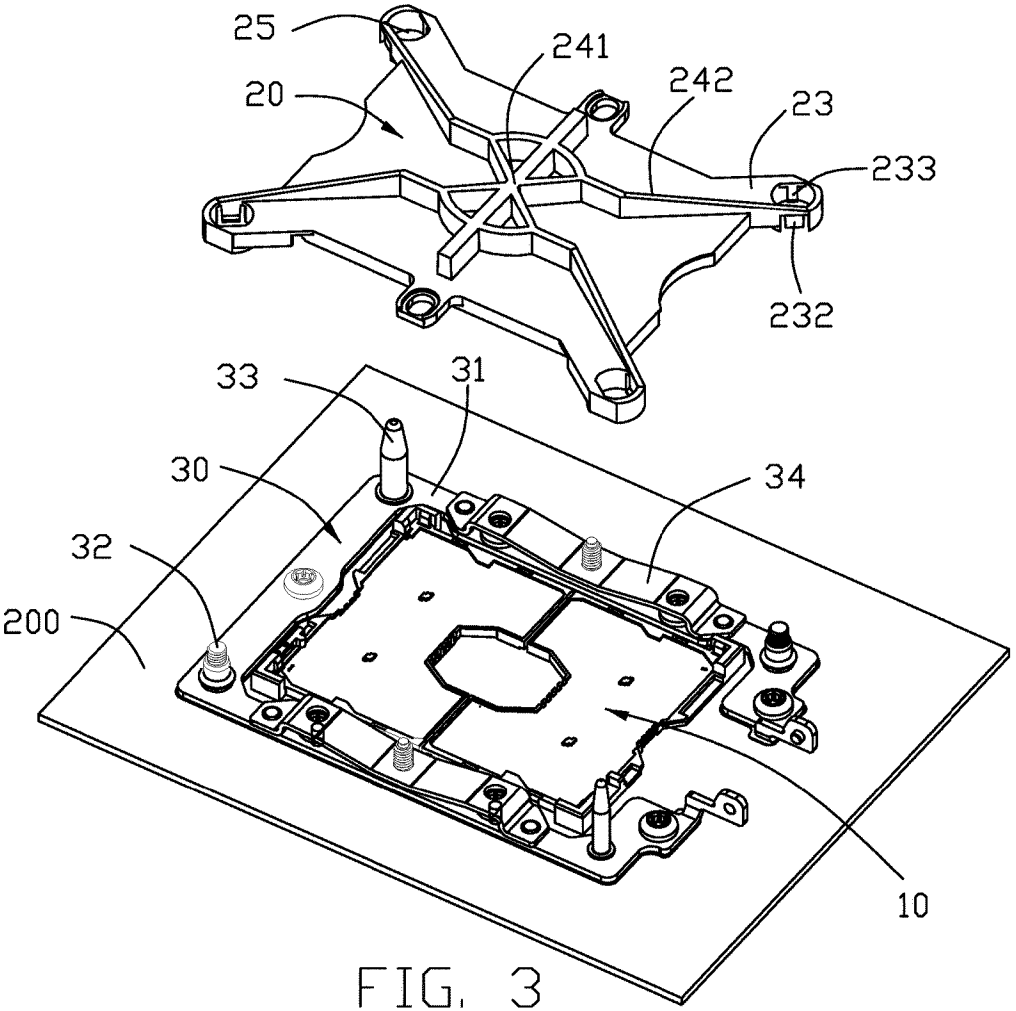
FIG. 3 is an exploded perspective view of the electrical connector assembly of FIG. 1 wherein the cap is removed from the connector.
Figure 4:
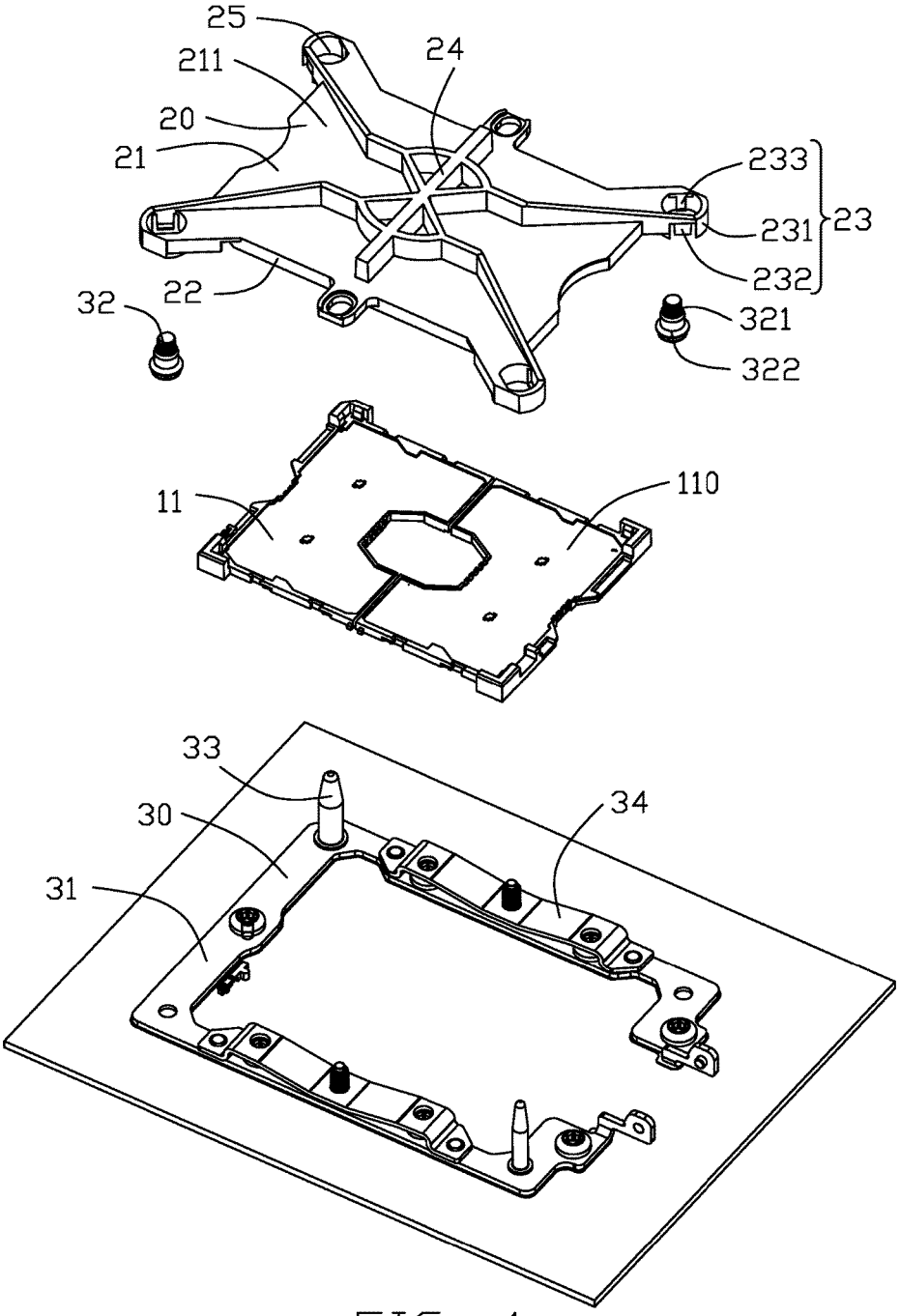
FIG. 4 is a further exploded perspective view of the electrical connector assembly of FIG. 3 wherein the electrical connector is removed from the printed circuit board.
Figure 5:
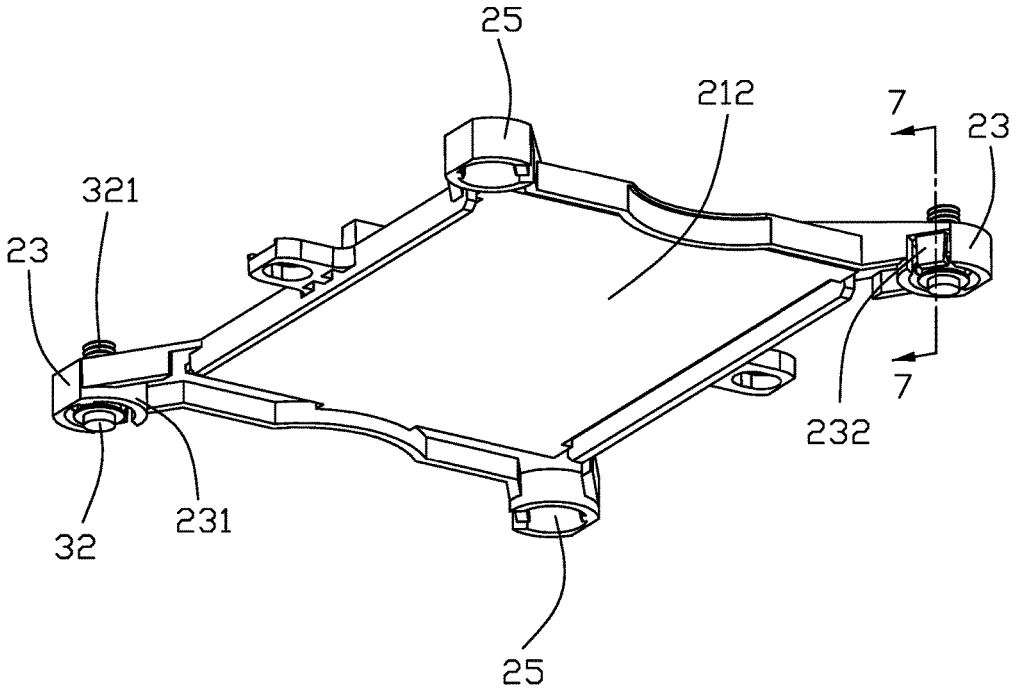
FIG. 5 is a perspective view of the protective cap of the electrical connector assembly with the corresponding second latching sections of FIG. 1.
Figure 6:
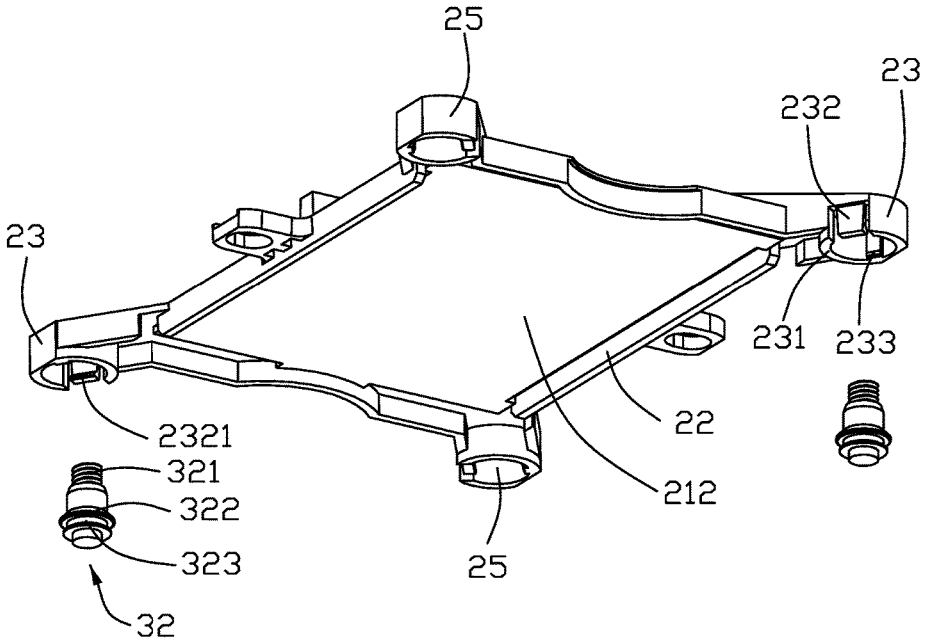
FIG. 6 is an exploded perspective view of the protective cap of the electrical connector assembly of FIG. 5 with the second latching sections being removed away therefrom.

Reference will now be made in detail to the embodiments of the present disclosure. Referring to FIGS. 1-7, an electrical connector assembly 100 for connecting an electronic package (not shown), e.g., CPU, to the printed circuit board 200, includes an electrical connector 10, a securing seat 30 surrounding the connector 10, and a protective cap 20 secured to the securing seat 30 and covering the electrical connector 10. The cap 20 is regularly positioned upon the connector 10 for dustproof and contact-protection. The cap 20 is initially rotated and successively upwardly withdrawn from the securing seat 30 and uncover the electrical connector 10 for loading the electronic package.

The electrical connector 10 includes an insulative housing 11 and a plurality of contacts (not shown) retained in the housing 11. The housing 11 forms a receiving cavity 110 for receiving the electronic package (not shown), and the contacts (not shown) extend into the receiving cavity 110 for contacting the electronic package (not shown). The cap 20 includes a planar body 21, four walls 22, a pair of first latching sections 23 and an operation section 24. The securing seat 30 includes a pair of second latching sections 32 for engagement with the first latching sections 23. In this embodiment, the second latching section 32 is columnar. When a rotational force F is applied upon the operation section 24, the engagement between the first latching section 23 and the corresponding second latching section 32 is somewhat eliminated.

Figure 7:
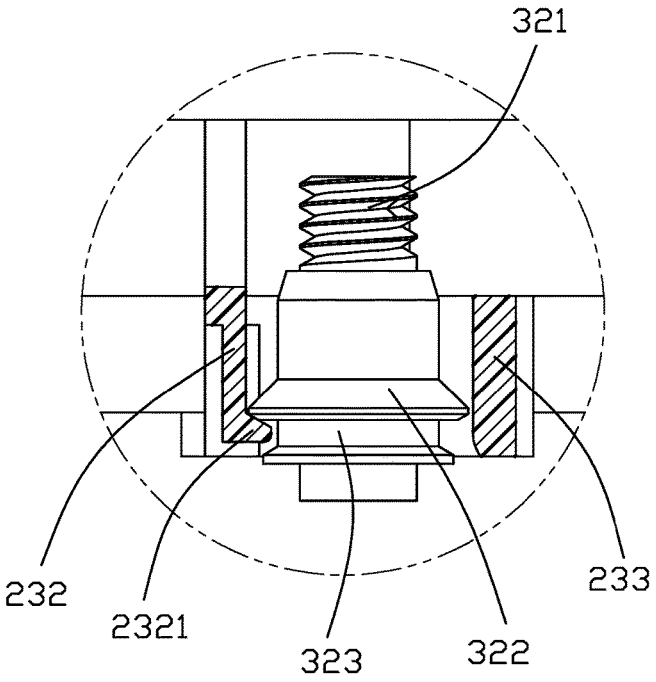
FIG. 7 is an enlarged cross-sectional view of a portion of the electrical connector assembly of FIG. 1.

The first latching section 23 has a ring structure with an annular wall 231 with a spring arm 232 thereof. The spring arm 232 is equipped with a hook 2321 at the free end. The annular wall 231 surrounds the second latching section 32, and extends downwardly beyond the spring arm 232 and the wall 22. The annular wall 231 forms an abutment section 233 diametrically opposite to the spring arm 232. As shown in FIG. 7, a tiny distance/gap is formed between the abutment section 233 of the first latching section 23 and the second latching section 32. During rotation/twisting of the cap 20 along direction S, the second latching section 32 abuts against the abutment section 233 of the first latching section 23, so the engagement amount between the spring arm 232 and the second latching section 32 is minimized. Under such a situation, the operator can easily upwardly withdraw the cap 20 from the securing seat 30. Understandably, during rotation of the cap 20, the deformation of the annular wall 231 due to confrontation between the second latching section 32 and the abutment section 233, may allow the spring arm 232 to leave away from the second latching section 32 for easily disengaging the corresponding hook 2321 from the second latching section 32. The second latching section 32 has a columnar structure and forms annular grooves to receive the corresponding hook 2321 of the spring arm 232. In other words, the spring arm 232 results in a one side engagement with regard to the annular grooves 323.

The cap 20 is insulative and the planar body is rectangular with a pair of first latching sections 23 in a diagonal direction and a pair of positioning sections 25 in the other diagonal direction. The securing seat 30 is rectangular with a pair of second latching sections 32 in one diagonal direction corresponding to the pair of first latching sections 23, and a pair of positioning posts 33 in the other diagonal direction corresponding to the pair of positioning sections 25. When rotating the cap 20, the pair of first latching sections 23 are both disengaged from the pair of second latching sections 32. If necessary, the first latching sections and the second latching sections may be applied to four corners rather than two opposite corners, and other arrangements are as well as long as the engagement therebetween occurs either commonly clockwise or counterclockwise with regard to a common center. Anyhow, the amount of the engagement between the first latching section and the second latching section is preferred to be even and the arrangement is symmetrical with regard to the rotation center. The positioning section 25 surrounds the corresponding positioning posts with a gap therebetween for allowing rotation of the cap 20.

The operation section 24 includes a twisting section 241, and a bridging section 242 linked between the twisting section 241 and the corresponding spring arm 232. In details, the bridging section 241 is linked to the annular wall 231 at the corresponding spring arm 232 thereof. Therefore, the forces applied upon the twisting section 241 may be efficiently transferred to the spring arm 232. The planar body 21 includes opposite bottom surface 212 and upper surface 211. In this embodiment, the twisting section 241 and the bridging section 242 commonly form a "*" like structure on the upper surface 211. The twisting section 241 further forms the arc ribs (not labeled) for reinforcement.

The electronic package and the heat sink (both not shown) are attached upon the housing 11 via securing to the securing seat 30. The securing seat 30 includes a seat body 31, the pair of second latching sections or screws 32, and the pair of positioning posts 33. The screw 32 includes a threaded section 321 for securing the heat sink, and a skirt section 322 below the threaded section 321. As shown in FIG. 7, the screw 32 further unitarily forms a the second latching section below the skirt section 322. A annular or locking groove 323 is formed below the skirt section 322, and the hook 2321 of the spring arm 232 is locked within the annular groove 323. In this embodiment, the hook 2321 forms an upward tapered surface for easing detachment. A pair of metallic spring pieces 34 is positioned upon the securing seat 30 for supporting the heat sink.

In brief, firstly by applying a rotation force along the direction S upon the twisting section 241, the hook 2321 of the spring arm 232 may fully or partially leave the corresponding annular groove 323. Secondly, when the user feels the skirt section 322 of the second latching section 32 abuts against the abutment section 233 of the first latching section 23, the cap 20 may be upwardly withdrawn away from the connector 10 and the securing seat 30. Oppositely, during assembling the cap 20 to the securing seat 30, the pair of positioning posts 33 are aligned with the pair of corresponding positioning section 25 firstly, and the cap 20 is downwardly pressed to have the spring arm 232 move along the skirt section 322 until into the annular groove 323.

Notably, the conventional design requires to apply the force directly upon the latching arm to have the corresponding hook, which is located at the free end of the latching arm, moved and disengaged from the locking part of the securing seat. Differently, in the invention the primary twisting force is applied through the bridging section 242 to the corresponding annular wall 231, and the corresponding spring arm 232 is essentially imposed upon no twisting force. In opposite, the spring arm 232 experiences only much less deflection force during upward withdrawal of the cap 20 from the securing seat 30 because the engagement of the hook 232 in the annular groove 323 has been lessened after the initial twisting. In other words, the conventional design have the same part endure the whole deflection force while the instant invention have two different parts to endure the deflection force wherein the part having the corresponding hook experiences much less than the other. Therefore, the invention may efficiently prevent improper wearing or damage of the corresponding latching section having the hook thereon. On the other hand, from another technology viewpoint, in the invention, the force arm is deemed measured from the rotation center to the corner where the first latching section 23 is located, compared with the conventional one having the force arm only extending with a relatively short distance at the corner itself. Therefore, the invention may perform an effective arrangement due to a longer force arm during operation. Another feature of the invention is to configure the first latching section and the second latching section in a manner to be disengaged from each other only the protective cap 20 is moved under a rotational manner about a vertical center axis. Understandably, the plurality of the paired first latching sections and second latching sections had better be arranged diagonally and symmetrically. A further feature of the invention is to provide a delicate two-step method for withdrawing the cap 20 from the securing seat 30, i.e., the initial rotation/twisting, and the successive upward moving. Differently, in the conventional design, the protective cap is essentially directly upwardly moved for disengaging the first latching section from the second latching section brutally. Notably, the hook of the first latching section and the locking groove of the second latching section may be interchanged with each other, if proper. Notably, in this embodiment, the position of the spring arm is essentially directed to a tangent line with regard to the rotation center for being sensitive to rotational movement of the cap to escape therefrom.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

an electrical connector including an insulative housing and a plurality of contacts disposed in the housing;

a securing seat at least partially surrounding the connector; and a protecting cap detachably attached upon the securing seat and covering the connector in a vertical direction; wherein the cap forms a first latching section and the securing seat forms a second latching section engaged with the first latching section in the vertical direction; wherein the first latching section and the second latching section are configured to be disengaged from each other via a rotation of the protective cap about a vertical axis at a center thereof; wherein the first latching section includes a downwardly extending spring arm thereof, the second latching section includes a locking groove therein, and the spring arm has a hook at a bottom end to be engaged within the locking groove; wherein said first latching section includes an annular wall and the spring arm is a part of said annular wall, and the second latching section is a columnar part received within the annular wall.

2. The electrical connector as claimed in claim 1 wherein said second latching section is a screw having a threaded section above the locking groove.

3. The electrical connector as claimed in claim 2 wherein said locking groove is annular.

4. A method of disassembling a protective cap from a securing seat, comprising steps of:

providing an electrical connector at least partially surrounded by said securing seat;

providing said protective cap with a first latching section and covering the electrical connector in a vertical direction;

providing said securing seat with a second latching section which is engaged with the first latching section; and initially rotating the protective cap about a vertical axis to disengage the first latching section from the second latching section, and successively upwardly removing the protective cap away from both the securing seat and the electrical connector upwardly in the vertical direction; wherein the first latching section has a downwardly extending spring arm with a hook at a free end, and the second latching section has a locking groove in which the hook is engaged; wherein the first latching section is an annular wall and the spring arm is a part thereof.

* * * * *